US007827748B2

(12) United States Patent
Brown

(10) Patent No.: US 7,827,748 B2
(45) Date of Patent: Nov. 9, 2010

(54) TOWER FOUNDATION

(75) Inventor: Franklin Brown, Clarkesville, GA (US)

(73) Assignee: Dixie Precast, Inc., Austell, GA (US)

( * ) Notice: Subject to any disclaimer, the term of this patent is extended or adjusted under 35 U.S.C. 154(b) by 470 days.

(21) Appl. No.: 10/851,443

(22) Filed: May 21, 2004

(65) Prior Publication Data

US 2005/0257462 A1 Nov. 24, 2005

(51) Int. Cl.
*E02D 27/32* (2006.01)
*E02D 27/42* (2006.01)
*E02D 27/00* (2006.01)

(52) U.S. Cl. ..... 52/295; 52/296; 52/292; 52/169.9; 52/170; 52/651.01

(58) Field of Classification Search ..... 52/293.2, 52/505, 301, 299, 169.9, 742, 252, 598, 605, 52/592.5, 651.01–651.1, 169.1–169.2, 169.8, 52/169.13, 170, 294–298, 253; 405/297, 405/252, 298
See application file for complete search history.

(56) References Cited

U.S. PATENT DOCUMENTS

| | | | | |
|---|---|---|---|---|
| 178,438 | A | 6/1876 | Hill | |
| 1,033,887 | A * | 7/1912 | Griffen | 52/295 |
| 1,069,328 | A * | 8/1913 | Griffen | 52/295 |
| 1,447,942 | A | 3/1923 | Fitzgerald | |
| 1,529,895 | A | 3/1925 | Chance et al. | |
| 1,600,895 | A | 9/1926 | Larry et al. | |
| 1,647,925 | A | 11/1927 | May | |
| 2,282,251 | A | 5/1942 | Schwendt | |
| 2,367,146 | A | 1/1945 | Siebs | |
| 2,373,798 | A | 4/1945 | Williams | |
| 2,374,624 | A | 4/1945 | Schwendt | |
| 2,381,014 | A | 8/1945 | Thornley | |
| 2,917,901 | A | 12/1959 | Lackner | |
| 3,579,935 | A * | 5/1971 | Regan et al. | 52/125.1 |
| 3,653,168 | A * | 4/1972 | Cook | 52/294 |
| 3,956,862 | A * | 5/1976 | Alexandre, Jr. | 52/286 |
| 4,190,384 | A * | 2/1980 | Neumann | 405/284 |
| 4,512,685 | A * | 4/1985 | Hegle | 405/284 |
| 4,592,678 | A | 6/1986 | McNinch, Jr. et al. | |
| 4,672,782 | A * | 6/1987 | Richter et al. | 52/218 |
| 4,704,052 | A | 11/1987 | Aubert | |
| 4,769,964 | A * | 9/1988 | Johnson et al. | 52/405.4 |
| 4,783,935 | A | 11/1988 | Creager | |
| 5,031,376 | A * | 7/1991 | Bender et al. | 52/609 |

(Continued)

FOREIGN PATENT DOCUMENTS

| | | |
|---|---|---|
| NL | 8004538 | 3/1982 |

*Primary Examiner*—Jeanette E. Chapman
(74) *Attorney, Agent, or Firm*—Baker Donelson

(57) ABSTRACT

A tower foundation (10) comprises a base slab (11), a plurality of pillar slabs (12), and a crown stab (13). The base slab (11), pillar slabs (12) and crown slab (13) are all retained in position by six steel guide rods (18) that extend upwardly from the base slab (11). The six guide rods (18) have externally threaded ends configured to receive internally threaded mounting bolts (20). The guide rods are arranged in a generally triangular pattern. The pillar slabs are rectangular with their sides being undercut or sloping outwardly from the bottom surface to the top surface, i.e., the sidewalls diverge outwardly as they extend upwardly. The outwardly sloping sidewalls aid in preventing the foundation from tilting over time.

13 Claims, 2 Drawing Sheets

U.S. PATENT DOCUMENTS 5,231,808 A * 8/1993 Angelette ..... 52/122.1
5,257,489 A * 11/1993 Angelette ..... 52/295
5,746,036 A 5/1998 Angelette
6,141,936 A 11/2000 Butler, Jr.
6,176,055 B1 * 1/2001 Fu ..... 52/292
6,216,403 B1 4/2001 Belbeoc'h

* cited by examiner

TOWER FOUNDATION

TECHNICAL FIELD

This invention relates to foundations, and particularly to tower foundations made of precast concrete components.

BACKGROUND OF THE INVENTION

Today there exists a vast number of towers, such as cellular telephone towers, being erected across the country. Each tower includes a foundation embedded within the ground which prevents the tower for toppling over.

In the past, these foundations have been constructed by merely digging a hole in the ground and filling the hole with concrete to which the upright towers is anchored. This has been costly in that it is required that mixed concrete in fluid form be transported to each site.

Accordingly, it is seen that a tower foundation has long remained needed that may be erected in a more cost efficient manner. It is to the provision of such therefore that the present invention is primarily directed.

SUMMARY OF THE INVENTION

A tower foundation comprising a base slab, a plurality of upright guide rods extending from said base slab; at least one pillar slab mounted upon said base slab and having said guide rods extending therethrough, said pillar slab having outwardly sloping sidewalls as they extend upwardly; and a crown slab mounted upon said pillar slab and having said guide rods extending therethrough.

DETAILED DESCRIPTION

Figure 1:
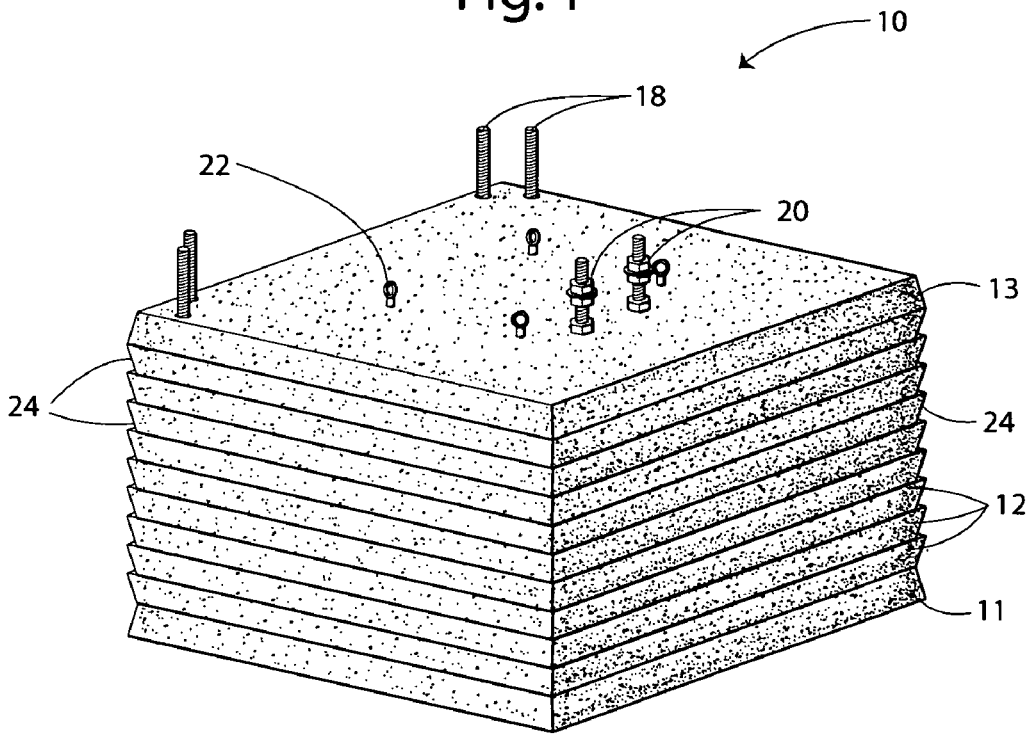
FIG. 1 is a perspective view of a tower foundation embodying principles of the invention in a preferred form.

With reference next to the drawing, there is shown a tower foundation 10 of the present invention in a preferred form. The foundation here has a base or bottom slab 11, a plurality of pillar or middle slabs 12, and a crown or top stab 13, all of which are made of precast concrete structures. The base slab 11, pillar slabs 12 and crown slab 13 are all retained in position by six steel guide rods 18 that extend upwardly from the base slab 11. The six guide rods 19 have externally threaded ends 19 configured to receive internally threaded mounting bolts 20. The guide rods 18 are arranged in a generally triangular pattern. The term triangular patters in intended to include truncated triangular patterns and is not intended to be construed to mean that a guide rod must be positioned at the exact corner or corners of the triangular pattern.

The base slab 11, pillar slabs 12 and crown slab 13 are manufactured in molds shown and described in detail in U.S. Pat. No. 5,257,489, which is specifically incorporated herein. The molds have side wall surfaces that are tapered which results in the slabs sides being tapered, as described in more detail hereafter.

Figure 2:
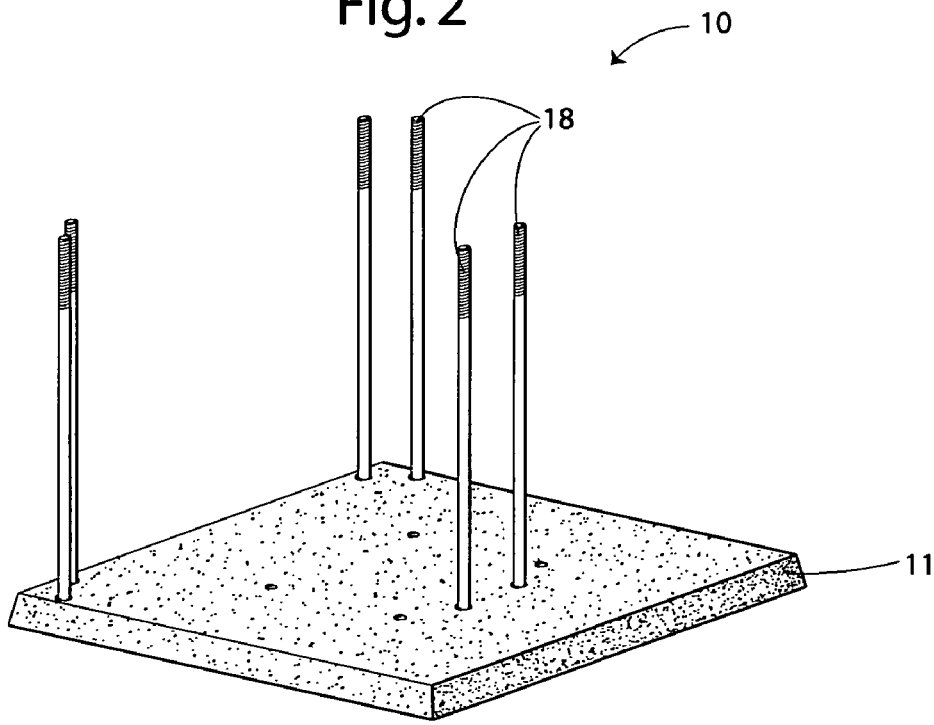
FIG. 2 is a perspective view of the base slab of the foundation of FIG. 1.
Figure 3:
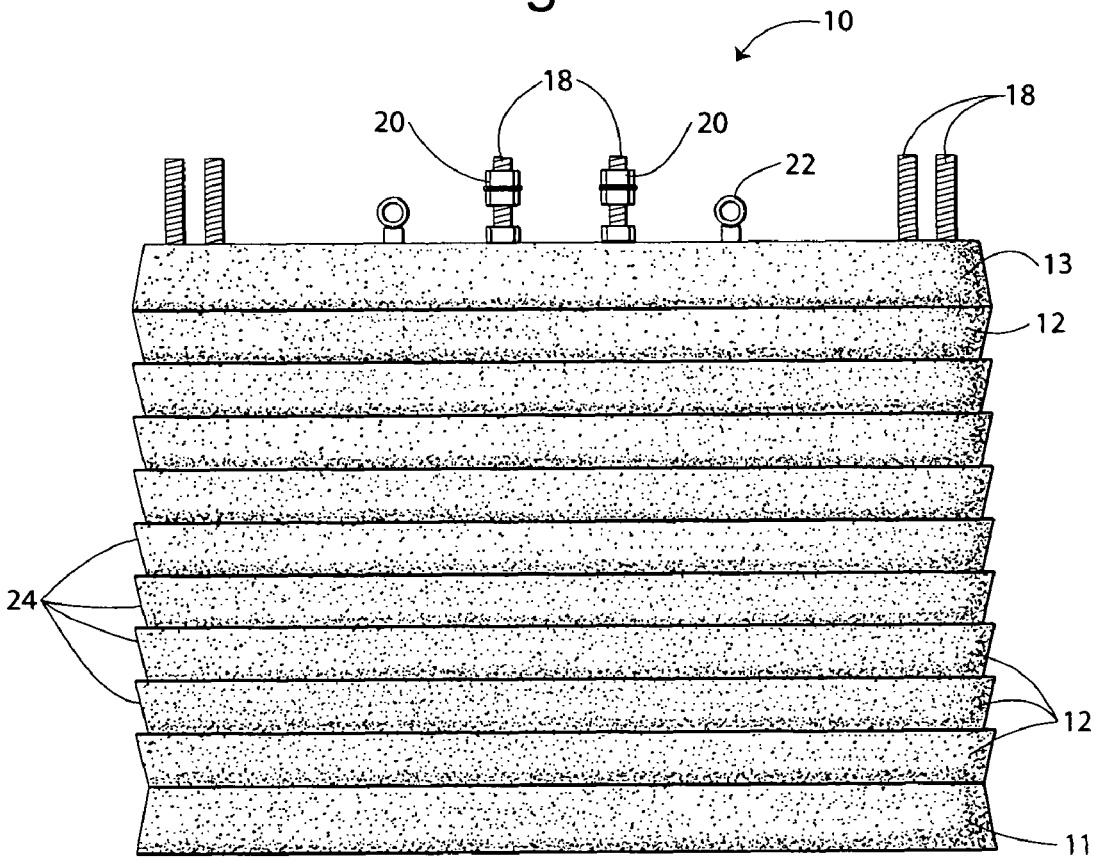
FIG. 3 is a side view of a portion of the foundation of FIG. 1.

Once made, the base slab 11 is of an extremely strong and rigid construction. It also has six tapered holes that extend down to six unshown anchor plates to which guide rods 18 may be mounted. The six guide rods 18 are then mounted to the base slab 11, as shown in FIG. 2.

The nine pillar slabs 12 that rests upon the base slab 11 are produced in a similar manner. The pillar slabs 12 have six holes extending therethrough positioned to be aligned with the guide rods 18. The pillar slabs 12 are mounted on the six guide rods 18 atop the base slab 11.

Finally, the crown slab 13 is mounted atop the pillar slabs 12. The concrete crown slab 13 has six holes extending therethrough through which the guide rods 18 extend. The crown slab also includes four eye bolts extending from the top surface.

With this construction, the threaded top ends 19 of the guide rods extend past the top surface of the crown slab 13. The tower is coupled to the top end 19 and secured in place by bolts 20.

The pillar slabs here are rectangular with their sides being undercut or sloping outwardly from the bottom surface to the top surface, i.e., the sidewalls 24 diverge outwardly as they extend upwardly. The outwardly sloping sidewalls 24 aid in preventing the foundation from tilting over time. Once the foundation is placed in the ground and the dirt is packed tightly around the foundation the dirt is pressed tightly against the sidewalls 24 of the pillar slabs. Should the foundation commence to tilt the sidewalls will further compress the adjacent dirt, as such, the compressed dirt becomes less susceptible to being further compressed and thereby resists further tilting of the foundation. If the sidewall were to be vertical or inwardly sloping from the bottom to the top this compression of the dirt would not occur or would not occur to such a degree. Also, with such a configuration the bottom edge would tend to gouge the dirt thereby creating a void into which the side walls could easily pass, thereby allowing for greater tilting of the foundation. This prevention of the tilting of the foundation with the configuration of the side walls of the present invention is a great improvement in the very old art of foundations.

The foundation of FIG. 1 has slabs 15 that measure 6 feet six inches by six feet six inches and a height of six inches. This slab also has an approximate weight of 2,940 pounds.

Typically, the foundation of FIG. 1 is used to support cellular towers or the like, but may be used for any type of tower, signage, signal or other device. As such, the term tower foundation is not meant to be a limitation, but merely a description of one use of structure used in conjunction with the foundation.

It should be understood that any number and peripheral shape of pillar slabs may be utilized with the present invention, the number depending on the size and weight of the slabs and on the size, height and weight of the tower coupled thereto. Also, it should be understood that the base and crown slabs may also be configured to have outwardly sloping sidewalls from the bottom surface to the top surface.

It thus is seen that a tower foundation is now provided that overcomes problems long associated with those of the prior art. It should be understood however that many modifications, additions and deletions may be made to the embodiments specifically described without departing from the spirit and scope of the invention as set forth in the following claims.

The invention claimed is:

1. A tower foundation comprising a generally rectangular and planar base slab; a plurality of upright guide rods extending from said base slab; a plurality of generally rectangular and planar pillar slabs mounted upon said base slab and having said guide rods extending therethrough, each pillar slab of said plurality of pillar slabs having a bottom surface, a top surface, and four side walls extending from said bottom surface to said top surface along the entire periphery of said pillar slab and each of said four side walls sloping outwardly as they extend upwardly; and a crown slab mounted upon said pillar slab and having said guide rods extending therethrough.

2. The tower foundation of claim 1 wherein each pillar slab of said plurality of pillar slabs is of substantially the same size and shape.

3. The tower foundation of claim 1 wherein each said pillar slab of said plurality of pillar slabs has multiple said sidewalls, and wherein all said sidewalls are outwardly sloping as they extend upwardly.

4. A tower foundation comprising a generally rectangular and planar lower concrete base slab to which a set of upright guide rods is mounted; a plurality of generally rectangular and planar upper concrete pillar slabs supported upon said lower base slab through which said guide rods extend, each pillar slab having a bottom surface, a top surface, and two pairs of oppositely disposed side walls extending from said bottom surface to said top surface along the entire periphery of said pillar slab; and a concrete crown slab mounted upon said plurality of pillar slabs through which said guide rods extend, and wherein at least two vertically adjacent pillar slabs of said plurality of upper concrete pillar slabs each have each pair of side wall of said two pairs of oppositely disposed side walls diverging from each other as they extend upwardly.

5. The tower foundation of claim 4 wherein said guide rods are arranged in a triangular pattern.

6. The tower foundation of claim 1 wherein said base slab has a select width and wherein each said pillar slab of said plurality of pillar slabs has a select width equal to said base slab select width.

7. The tower foundation of claim 6 wherein each said pillar slab of said plurality of upper concrete pillar slabs is of substantially the same shape and size.

8. The tower foundation of claim 1 wherein each said pillar slab of said plurality of upper concrete pillar slabs has multiple said sidewalls, and wherein all said sidewalls are outwardly sloping as they extend upwardly.

9. The tower foundation of claim 4 wherein said base slab has a select width and wherein each said pillar slab of said plurality of pillar slabs has a select width equal to said base slab select width.

10. The tower foundation of claim 4 wherein each said pillar slab of said plurality of upper concrete pillar slabs is of substantially the same shape and size.

11. The tower foundation of claim 4 wherein each said pillar slab of said plurality of upper concrete pillar slabs has multiple said sidewalls, and wherein all said sidewalls are outwardly sloping as they extend upwardly.

12. A tower foundation comprising;

a generally rectangular and planar base slab having a select width;

at least two generally rectangular and planar pillar slabs positioned vertically adjacent to each other upon said base slab, said two adjacent pillar slabs each having four side walls that slope outwardly as they extend upwardly between a bottom of said pillar slab to a top of said pillar slab;

a crown slab mounted upon said pillar slabs; and guide rods extending therethrough said pillar slabs and said crown slab.

13. The tower foundation of claim 12 wherein said base slab and said pillar slabs are of substantially the same size and shape.

* * * * *